US005172498A

United States Patent [19]

Wack

[11] Patent Number: 5,172,498

[45] Date of Patent: Dec. 22, 1992

[54] SHOVEL FOR EARTHMOVING EQUIPMENT

[76] Inventor: Helmut Wack, Am Langen Zaun Nr. 7, D-6653 Blieskastel, Fed. Rep. of Germany

[21] Appl. No.: 731,668

[22] Filed: Jul. 17, 1991

[30] Foreign Application Priority Data

Feb. 18, 1991 [DE] Fed. Rep. of Germany ..... 4104950

[51] Int. Cl.[5] ..... E02F 3/40

[52] U.S. Cl. ..... 37/103; 37/DIG. 18; 209/393; 209/421; 171/132; 414/725

[58] Field of Search ..... 37/103, DIG. 2, DIG. 18; 209/393, 420, 421, 418, 419; 414/725; 171/132

[56] References Cited

U.S. PATENT DOCUMENTS

| | | | |
|---|---|---|---|
| 683,775 | 10/1901 | Kirkpatrick | 209/419 |
| 3,003,265 | 10/1961 | Lutjens | 209/421 X |
| 3,072,257 | 1/1963 | Hockenberry | 171/132 |
| 3,395,798 | 8/1968 | Erickson | 209/421 |
| 3,461,968 | 8/1969 | Longley | 171/132 |
| 4,698,925 | 10/1987 | Jones et al. | 37/2 R |
| 4,805,703 | 2/1989 | Carlsson | 37/118 A X |

FOREIGN PATENT DOCUMENTS

| | | | |
|---|---|---|---|
| 210661 | 8/1960 | Austria | 171/132 |
| 218299 | 11/1961 | Austria | 171/132 |
| 3101606 | 8/1982 | Fed. Rep. of Germany | 171/132 |
| 1291555 | 10/1972 | United Kingdom | 171/132 |
| WO90/12929 | 11/1990 | World Int. Prop. O. . | |

*Primary Examiner*—Randolph A. Reese
*Assistant Examiner*—Arlen L. Olsen
*Attorney, Agent, or Firm*—Antonelli, Terry, Stout & Kraus

[57] ABSTRACT

A shovel for earthmoving equipment such as excavators, wheel loaders, etc., has two side walls, which are interconnected by a shovel bottom positioned between the side walls. The shovel bottom is at least zonally formed by a lattice-like grating, which is movably mounted on the shovel and which can be vibrated. The lattice-like grating is preferably mounted in vibration-damped manner and is driven by a hydraulic motor, which is connected to the hydraulic circuit of the excavator or wheel loader.

17 Claims, 4 Drawing Sheets

SHOVEL FOR EARTHMOVING EQUIPMENT

The present invention relates to a shovel for earthmoving equipment such as, for example, excavators, wheel loaders, etc. with the shovel including two side walls and a shuffle bottom located between the side walls and interconnecting the latter.

BACKGROUND OF THE INVENTION

Shovels of the aforementioned type are constructed as convertible attachments for excavators, wheel loaders or corresponding working implements and have two steel side walls, which are substantially parallel and reciprocally spaced from one another. A steel shovel bottom extends between the side walls, with the steel shovel bottom interconnecting the side walls at one end thereof and defining at least one open side, thereby forming a skip-like shovel.

Conventionally, a wedge-shaped pickup ledge is provided on the lower edge of the shovel bottom, with the ledge having teeth for facilitating a penetration of the shovel into the soil or material to be picked up. The teeth and optionally also the ledge are made from hardened wear-resistant steel and, when the teeth and/or the ledge become worn, they are replaced or repaired by deposit welding. Shovels of this type are also referred to a loading shovels. They are also so-called hinged shovels, which comprise two shovels corresponding in a draw-like manner and which fundamentally have the same construction as a loading shovel and, the subject matter of the present invention is directed to both types of shovels.

The shovel is, for example, fitted to the free end of an excavator shaft and connected to the hydraulic circuit of the excavator, so that the shovel can be pivoted together with the cantilever arm and the excavator shaft and is also adjustable relative to the shaft. The shovel is normally used for digging out pits and trenches, for moving and taking up dumped material and also for loading vehicles with loose material or displacing the latter.

Recently such shovels have been increasingly used for working up natural or artificial raw and building materials, i.e. for recycling. For example, specific reference is made here to the recovery of concrete building materials. On removing or demolishing concrete structures or components generally relatively large fragments are formed, which are too large and heavy to be reused in a simple manner. Therefore the concrete fragments are directly crushed with the demolition apparatus or in separate crushing plants to a size such that they can be given an appropriate reuse function, dependent on the nature and characteristics of the concrete.

For transporting and loading, as well as for transporting the demolished material to the crushing plant, use is normally made of earthmoving equipment such as excavators, wheel loaders, etc., which are provided with a loading shovel of the aforementioned type. The demolition material taken up in this way comprises, apart from relatively large fragments which are still to be crushed, pieces of concrete which already have such a limited size that further crushing in the crushing plant is not needed and may not in any case be possible. If these small concrete fragments are still supplied to the crushing plant, its remaining capacity for large fragments to be crushed is reduced. Therefore the operating efficiency of the crushing plant, i.e. the quantity of crushed material per unit of time is reduced. In fact, material of very small particle size is highly undesirable in crushing plants, because the small particle size leads to increased wear to the crushing tools and to other malfunctions.

It is therefore appropriate to carry out a presorting of the demolition material before it is supplied to the crushing plant. This could take place by a known shovel having in one or more slits on the bottom thereof and which is, in particular, used for separating solids and liquids. Although such a slit arrangement is adequate for the screening action when separating a liquid from a solid, e.g. for draining soil taken up with the shovel when digging pits or when excavating underwater, but it has been found that demolition material cannot be sorted with such a shovel, because the concrete fragments frequently build up in front of the slits or are jammed in the latter, so that the slits lose their sorting action. In this way more small material is held back in the shovel without the desired screening or sorting action occurring and the material then undesirably passes into the crushing plant.

In order to avoid the aforementioned disadvantages, an attempt has been made to use a convertible attachment in the form of a rotary drum, i.e. a revolving screen. The latter has a closable opening, which can be used for taking up the material to be sorted. After closing the opening the drum is vibrated, so that the material contained therein is presorted or screened out, accompanied by a constant revolution action. However, such a revolving screen is not only constructionally very complicated and therefore expensive, but the sorting of the material is time and therefore cost-intensive. It is also not possible to use the drum for other purposes, e.g. for loading "screenings".

SUMMARY OF THE INVENTION

The aim underlying the present invention essentially resides in developing an earthmoving equipment shovel which achieves a reliable rapid and effective sorting or separation of the material in the shovel.

In accordance with advantageous features of the present invention, a shovel is provided when the shovel bottom is at least zonally formed by a lattice-like grating mounted on the shovel, which grating can be vibrated.

According to the invention, the shovel bottom, at least in zones thereof, comprises a grating mounted on the shovel, with the grating being vibratable with respect to the shovel. As a result of the lattice-like grating, a presorting or screening of the material in the shovel is possible. It is possible to effectively avoid a clogging or blockage of the grating by the vibratory movements which keep the material in constant movement. As a result it is possible to achieve a good, rapid sorting of small fragments to be sorted out, together with coarse demolition material. The inventive shovel can also be used without vibrating the lattice-like grating, so that its operation corresponds to a conventional loading or hinged shovel without or with an only limited sorting effect. Thus, the inventive shovel can be used in a universal manner and is therefore inexpensive to operate.

In accordance with further features of the present invention, the entire shovel of the bottom may be formed by a lattice-like grating so that it is possible to achieve a very rapid separation of the material to be sorted. It is, in particular, possible to avoid any zonal buildup of the material in the shovel, thereby reducing the screening action. It is advantageous to mount the lattice-type grating on the side wall because the side walls are rigid and have a relatively high stability so that the mobility of the grating is not reduced by its mounting.

As noted hereinabove, loading and hinged shovels have, on the pick-up edge of the shovel bottom, a ledge having a wedge-shaped cross-section, which generally has wear-resistant teeth and, in accordance with still further features of the present invention, the ledge forming the pick-up edge thereof is located on a free lower edge of the shovel bottom and has a cross-sectional shape widening in a wedge-like manner into the shovel, with the inner upper edge of the ledge being higher than the top of the grating in an area connected to the ledge. By virtue of the last-mentioned features of the present invention, it is possible to ensure that the material slides upwardly over the wedge shaped ledge and onto the grating without the significant compressive and shear forces acting on the grating and bearing during a picking up of the material.

Advantageously, in accordance with the present invention, the grating may be mounted in a floating manner so as to provide the possibility of a vibratory movement and to enable the grating to contribute to the overall rigidity of the shovel.

The grating of the present invention may be mounted to conventional vibration dampers, for example, vibration mounts thereby providing for an inexpensive mounting arrangement and also the possibility of limiting the noise of the movement of the lattice-like grating which is highly advantageous with respect to workplace conditions as well as to the environment. Additionally, the vibration is not transferred by way of the attachment point of the shovel into the excavator shaft.

In order to substantially avoid any tilting of the grating and therefore ensure a high sorting action, it is also possible in accordance with the present invention to mount the lattice-like grating one each side wall by two vibration dampers.

Advantageously, in accordance with the present invention, the grating is driven by a hydraulic motor being used for producing the vibratory movement whereby, in a simple manner the hydraulic motor can be connected to the hydraulic equipment of the earthmoving equipment such as, for example, the excavator, wheel loader, etc., so no additional drive unit is necessary.

According to still further features of the present invention, a gear is interposed between the hydraulic motor and the grating. By virtue of the interposition of the gear between the hydraulic motor and the lattice-like grating, it is possible to convert the movement of the driven member of the hydraulic motor to an appropriate vibratory movement both with respect to the movement course and movement speed.

Advantageous, the gear may be constructed as an eccentric gear which is constructionally relative simple and is not susceptible to faults which is significantly advantageous in view of normally difficulty working conditions on building sites.

A construction which is vibration-stable and favorable with regards to the sorting effect is obtained in that the hydraulic motor and the gear are located roughly centrally on the shovel bottom and roughly centrally between the side walls. Further optimization results from the fact that the hydraulic motor and the gear are located roughly centrally between the vibration dampers on the side walls.

It has been found that when performing a circular vibratory movement a very good screening or sorting action is obtained. However, as a function of the material to be sorted or screened, it is also possible to have a linear vibratory movement or a combination of a circular and a linear vibratory movement. The vibratory movement can either be substantially parallel to the plane of the side walls or at right angles thereto. A movement parallel to the plane of the side walls leads to the advantage that the bearing forces, if the lattice-like grating is mounted on the side walls, act in the plane of the latter and unfavorable transverse forces can be kept low.

According to the present invention, the lattice-like grating comprises crescent-shaped disk segments, which are juxtaposed substantially parallel to the plane of the side walls, a high grating stability can be achieved. Even an impact of the back of the shovel e.g. on a concrete part to be demolished does not lead to a deformation of the lattice-like grating, because the forces are introduced substantially in the disk plane of the crescent-shaped disk segments and can therefore easily be dissipated.

It has been found that a good sorting action and an only limited vibration loading of the excavator or wheel loader can be obtained if the vibration frequency is approximately 2000 $min^{-1}$ and/or the vibration amplitude is 5 to 10 mm. As a function of the material to be sorted and the construction of the shovel and excavator/wheel loader, it is possible to use other frequencies or amplitudes and still obtain the advantages according to the invention.

BRIEF DESCRIPTION OF THE DRAWING

Other features and advantages of the invention can be gathered from the following description of a preferred embodiment and with reference to the attached drawings, wherein.

DETAILED DESCRIPTION

Figure 1:
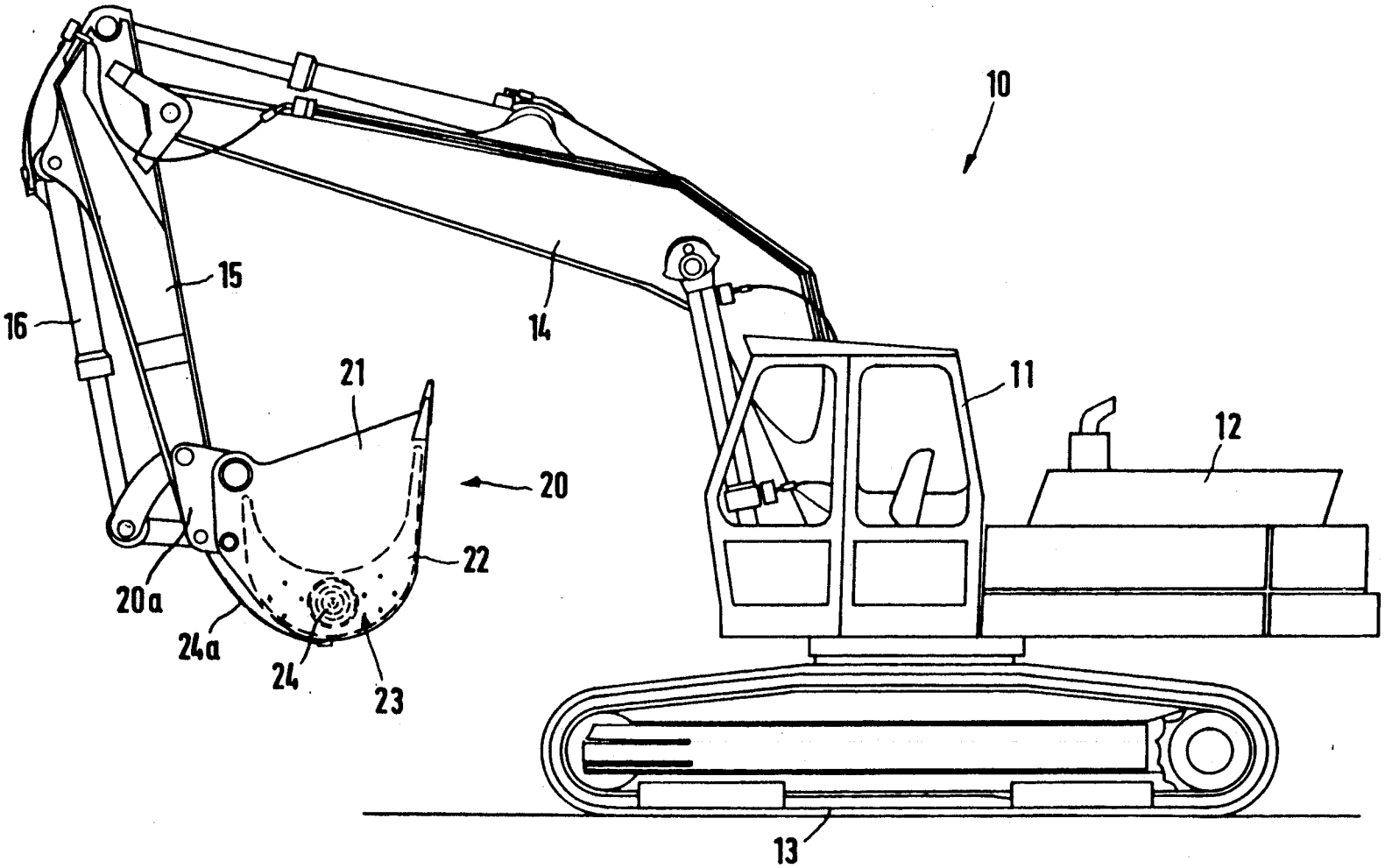
FIG. 1 is a side view of an excavator with a shovel.

According to FIG. 1 an earthmoving equipment in the form of an excavator 10 has a chassis 13 on which the superstructure is rotatably mounted. The superstructure comprises a driver's cab 11 and a motor 12, which is used both for moving the excavator 10 and for moving the convertible attachments fitted to the excavator. On the superstructure is also mounted a cantilever arm 14, to which is connected the excavator shaft 15. The cantilever arm 14 and the shaft 15 are movable both relative to one another and to the excavator superstructure by means of known hydraulic servodrives. On the free end of the excavator shaft 15 is mounted a shovel 20, which is pivotable by a piston-cylinder unit 16 relative to the excavator shaft 15 in the plane of FIG. 1.

Figure 2:
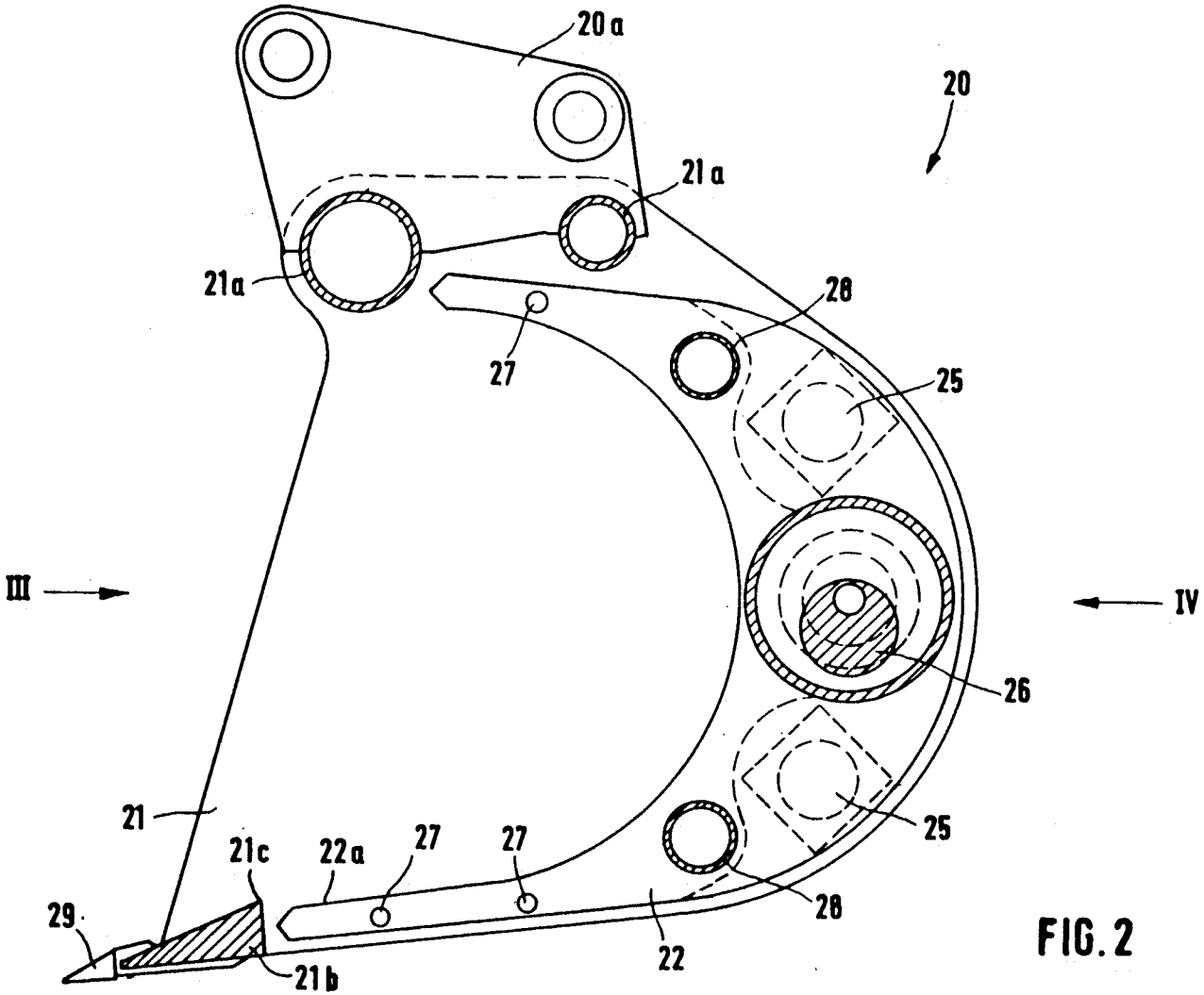
FIG. 2 is a section II—II through the shovel of FIG. 4.
Figure 3:
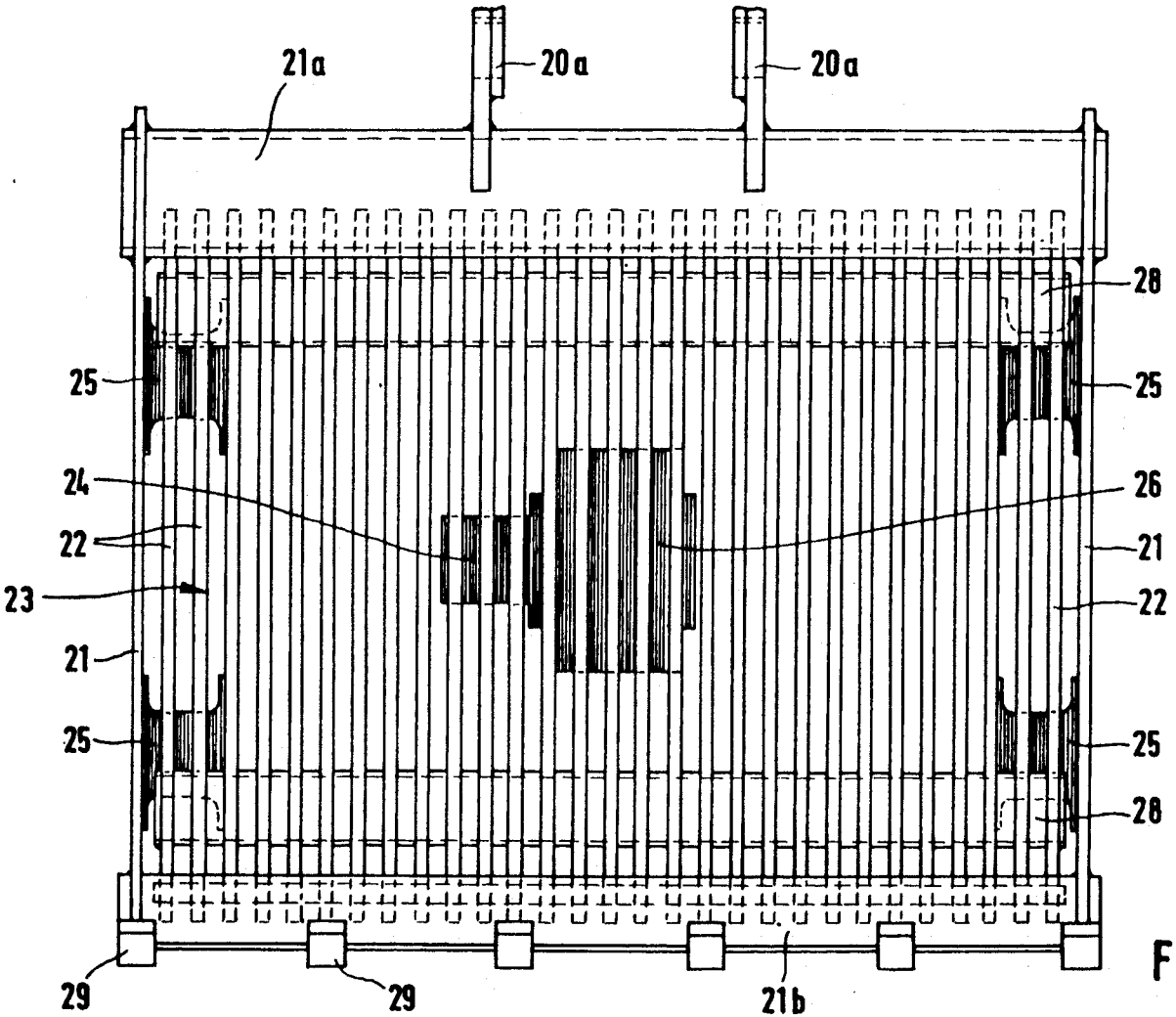
FIG. 3 is a view of the shovel in direction III of FIG. 3.
Figure 4:
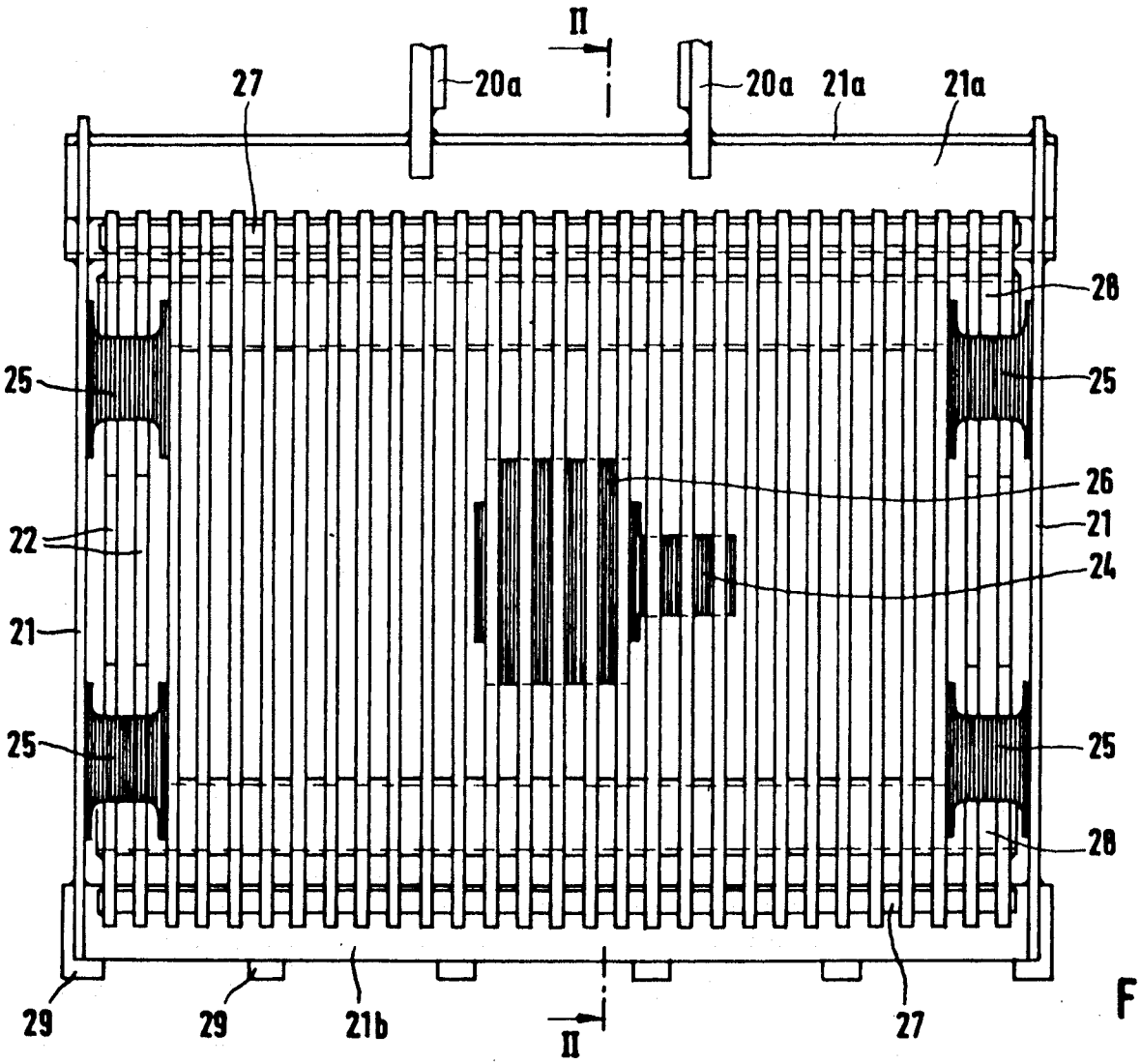
FIG. 4 is a view of the shovel in direction IV of FIG. 2.

FIGS. 2 to 4 are enlarged views of the shovel 20. As can in particular be gathered from FIG. 3 the shovel 20 has two side walls 21, which are connected at the top by means of crossmembers **21*a* and by means of the latter, as well as a cutting blade 21*b* are stiffened at the bottom. To the crossmembers 21*a* are fixed link plates 20*a*, by which the shovel can be fitted to the free end of the excavator shaft 15. On the cutter blade 21***b* are provided teeth 29, which facilitate the penetration of the shovel into the material to be picked up. The side walls 21, the crossmembers 21*a* and the cutting blade form a rigid, deformation-resistant frame.

In the frame is placed a lattice-like grating 23, which forms the shovel bottom. The lattice-like grating 23 comprises a plurality of crescent-shaped disk segments 22, which are juxtaposed substantially parallel to the plane of the side walls 21 and are kept spaced from one another by several transverse spars 27, 28. As shown in FIG. 2, the cutting blade 21*b* has a wedge-shaped cross-section. The upper edge 21*c* within the shovel is higher than the top 22*a* of the disk segments 22 in the area, so that on taking up the demolition material the latter are not loaded from the front by the working pressure of the shovel.

The lattice-like grating 23 is mounted by vibration dampers 25 on the side walls 21, two vibration dampers being provided on each side wall. Such a mounting of the grating 23 permits its movement relative to the rigid frame formed by the side walls 21, the crossmembers 21*a* and the cutting blade.

On the lattice-like grating 23 is located a hydraulic motor 24, which is connected by pressure lines 24*a* to the excavator hydraulic circuit, as shown in FIG. 1. Between the hydraulic motor 24 and the lattice-like grating 23 is placed a gear 26 in the form of an eccentric gear, as can in particular be seen in FIG. 2. If the hydraulic motor 24 is driven, the eccentric rotates in the plane of FIG. 2, so that the grating 23 performs a circular vibratory movement in the plane according to FIG. 2 or in a plane parallel thereto. Such a circular vibratory movement takes place substantially parallel to the plane of the side walls 21. As a result of the vibratory movement the material in the shovel 20, is kept in constant movement and is effectively sorted. It has been found that a vibration amplitude of 5 to 10 mm is sufficient to obtain a good sorting action. The vibration frequency should be approximately 2000 $min^{-1}$. However, as a function of the nature and characteristics of the material to be sorted, good results can also be obtained with other vibration frequencies.

As can in particular be gathered from FIG. 4 the hydraulic motor 24 and the gear 26 are positioned substantially centrally between the bearings or the vibration dampers 25 by which the grating is connected to the side walls 21. As can also be gathered from FIG. 1 the axes of the bearings or the vibration dampers and the hydraulic motor 25 or the gear 26 are only slightly displaced, which leads to a vibration-stable construction.

In place of the rotary vibration, it is also possible to have a linear vibration. However, then in place of the eccentric gear shown, use is made of a gear having a different construction, which converts the rotary movement of the hydraulic motor into a linear vibratory movement. The invention is not restricted to a vibration parallel to the plane of the side walls and it is also possible to excite the lattice-like grating substantially at right angles to the plane of the side walls, i.e. in the plane of FIGS. 3 and 4.

I claim:

1. Shovel for earthmoving equipment, the shovel comprising:

two side walls;

a shovel bottom located between the side walls and interconnecting said side walls;

a lattice grating forming at least a portion of the shovel bottom;

at least one vibration damper mounted on one end to said lattice grating and on the other end to respective side walls of the shovel; and a vibrator for vibrating the lattice grating.

2. Shovel according to claim 1 wherein the entire shovel bottom is formed by the lattice grating.

3. Shovel according to claim 1, further comprising with a ledge forming a pick-up edge of the shovel and located on a free lower edge of the shovel bottom said ledge having a cross section widening in a wedge manner into the shovel, and wherein an upper edge of the ledge is higher than a top of the lattice grating in an area connected to the ledge.

4. Shovel according to claim 1, wherein the lattice grating is mounted on each side wall by two vibration dampers.

5. Shovel according to claim 1, wherein the vibrator includes a hydraulic motor.

6. Shovel according to claim 5, wherein the hydraulic motor is connected to a hydraulic circuit of the earthmoving equipment.

7. Shovel according to claim 5, wherein a gear is interposed between the hydraulic motor and the lattice grating.

8. Shovel according to claim 7, wherein the gear is an eccentric gear.

9. Shovel according to claim 7, wherein the hydraulic motor and the gear are positioned substantially centrally on the shovel bottom and substantially centrally between the side walls.

10. Shovel according to claim 7, wherein the hydraulic motor and the gear are positioned substantially centrally between vibration dampers on the side walls.

11. Shovel according to claim 1, wherein the lattice grating performs a substantially circular vibratory movement.

12. Shovel according to claim 1, wherein the lattice grating performs a substantially linear vibratory movement.

13. Shovel according to claim 12, wherein a vibratory movement of the vibrator is substantially parallel to a plane of the side walls.

14. Shovel according to claim 12, wherein the circular movement is substantially at right angles to a plane of the side walls.

15. Shovel according to claim 1, wherein the lattice grating comprises crescent-shaped disk segments juxtaposed substantially parallel to a plane of the side walls, and wherein at least two transverse bars are provided for holding the disk segments.

16. Shovel according to claim 1, wherein a vibration frequency of the vibrator is approximately 2000 $min^{31\ 1}$.

17. Shovel according to claim 16, wherein a vibration amplitude of the vibrator is approximately 5 to 10 mm.

* * * * *